US007632368B2

(12) United States Patent
Fujita

(10) Patent No.: US 7,632,368 B2
(45) Date of Patent: Dec. 15, 2009

(54) LABEL STICKING DEVICE AND LABEL STICKING METHOD

(75) Inventor: Toshihiro Fujita, Tokyo (JP)

(73) Assignee: Lintec Corporation, Tokyo (JP)

( * ) Notice: Subject to any disclaimer, the term of this patent is extended or adjusted under 35 U.S.C. 154(b) by 859 days.

(21) Appl. No.: 11/196,457

(22) Filed: Aug. 4, 2005

(65) Prior Publication Data

US 2006/0027304 A1 Feb. 9, 2006

(30) Foreign Application Priority Data

Aug. 9, 2004 (JP) ..... 2004-231960

(51) Int. Cl.
*B32B 37/10* (2006.01)

(52) U.S. Cl. ..... 156/64; 156/277; 156/361; 156/367

(58) Field of Classification Search ..... 156/64, 156/277, 297, 299, 361, 367, 384, 387
See application file for complete search history.

(56) References Cited

U.S. PATENT DOCUMENTS 6,085,818 A * 7/2000 Takizawa et al. ..... 156/387
6,280,544 B1 * 8/2001 Fox et al. ..... 156/64

FOREIGN PATENT DOCUMENTS

JP 8-63100 3/1996

* cited by examiner

*Primary Examiner*—George R Koch, III
(74) *Attorney, Agent, or Firm*—Westerman, Hattori, Daniels & Adrian, LLP

(57) ABSTRACT

A label sticking device is provided with a suction head 50 which holds a label L peeled off from a release liner S in the process of paying out a raw sheet M, a camera 15 which inspects a position of the sucked label, a label-positioning device 16 which adjusts a positional deviation of the label when the deviation is detected, a printing device 17 which prints on an adhesive layer of the label, a shifter 18 which shifts the label printed toward an object to be stuck with the label, and a controller 20 which controls these devices.

14 Claims, 5 Drawing Sheets

LABEL STICKING DEVICE AND LABEL STICKING METHOD

BACKGROUND OF THE INVENTION

1. Field of the Invention

The present invention relates to a label sticking device and a label sticking method, and in particular, to a label sticking device and a label sticking method, in which, after labels are peeled off from a release liner one by one, printing is performed on a surface of an adhesive layer of the label, and the label with the printing can be stuck on an object to be stuck.

2. Description of the Related Art

There has been known a device in which, in the process of paying out a raw sheet where labels are temporarily stuck on one side of a strip-shaped release liner, the labels are peeled off and printing is performed on the surface of an adhesive layer thereof, and then, the labels are stuck on the object (refer to Patent document 1: Japanese Patent Application Laid-open No. 8-63100). This type of device has an advantage that the printed surface is interposed between the label and the object, which can prevent the printed surface from disappearing or fading due to rubbing, and thereby clearness of printed contents can be continuously secured.

In the label sticking device disclosed in the Patent Document 1, however, an accurate position of the label to be held is not considered well on the occasion of holding the label peeled from the release liner. For this reason, this type of device has such a disadvantage that, when a sticking position of the label to the object is required to be accurate, the device can not meet the requirement, thus the label is stuck at a position deviated from a required label sticking position.

In more detail, for example, in case of sticking a label on a plate forming a display face of a cell phone, one plate member bigger than a flat face of one label is used as the object, and the labels are sequentially stuck on the plate member in a manner of line arrangement, and thereafter, the labels are cut out in a size corresponding to the display face. In this case, since the label has to be stuck to the plate member at an appropriate position, it is required to control accurately the position to hold the label peeled off.

However, there may be a case where the label peeled off from the release liner deviates slightly from an appropriate position, such as a position of too much ahead, too behind or oblique in a plane. Such a deviation remains on the sticking face of the object as it is, consequently, in an embodiment where the labels are stuck on one plate member, the deviation causes a disadvantage that the plate member after being cut out is regarded as a defective piece.

SUMMARY OF THE INVENTION

The present invention has been proposed from a viewpoint of the foregoing disadvantages and an object of the present invention is to provide a label sticking device and a label sticking method in which, when holding labels peeled off from a release liner, even if a position of the label deviates, the position of the label is adjusted so that a correct label-holding position is obtained, thereby sticking position of the label to the object can be strictly controlled.

In order to achieve the object, a label sticking device according to the present invention in which a raw sheet, that includes a label being temporarily stuck on a face of a strip-shaped release liner, is paid out to peel off the label from the release liner, and also printing is performed on an adhesive layer of the label to stick the same on a predetermined object, comprising:

a holding device to hold the label peeled off from the release liner in the process of paying out the raw sheet; an inspection device to inspect a position of the label held on the holding device; a label-positioning device to adjust the holding position of the label to an appropriate position when a position of the label deviates out of a predetermined position of the holding device; a printing device to print on an adhesive layer of the label; a shifting device to shift the printed label toward the object; and a controller to perform predetermined controls for each of the devices.

The label-positioning device according to the present invention includes: a function to adjust inclination of the label by rotating the label within a plane; a function to adjust both end positions in the width direction perpendicular to the direction of paying out the label; and a function to adjust positions of front and rear ends along the paying-out direction.

And an inspection device may be preferably provided with a collector of defective labels and when the inspection device detects a defect of the label held in the holding device, the defective label is collected without printing on the label.

Further, the printing device may be provided with a function to print serial or variable information corresponding to an order of the labels to be stuck, and printing information is printed based upon the serial information at each time of printing when the label held in the holding device reaches a predetermined printing position.

Still further, such an arrangement may be adopted that the object is a plate-like body which is larger than a label plane size, and the labels are sequentially stuck in line arrangement on a face of the plate-like body.

Still further, the object is arranged to be supported by a predetermined conveyance device, wherein the conveyance device includes a position-holding device to keep the object in a predetermined position.

A label sticking method according to the present invention, in which a raw sheet, that includes labels being temporarily stuck on a face of a strip-shaped release liner, is paid out to peel off the label from the release liner, and also printing is performed on an adhesive layer of the label to stick the same on a predetermined object, adopts such an arrangement, comprising the steps of: inspecting whether or not the label is held at predetermined position when holding the label peeled off from the release liner; printing on an adhesive layer of the label on a condition that the label is at a predetermined position and sticking the label so that the printing face is interposed between the label and the object; adjusting a position of the label to be held at an appropriate position when positional deviation of the label is detected, thereafter, printing on the adhesive layer of the label and sticking the label so that the printing face is interposed between the label and the object.

And the printing in the label manufacturing method is to be serial information or variable information corresponding to an order of the labels to be stuck.

According to the present invention, since the label held in the holding device can be kept at an appropriate position, the present invention can be adapted to a case where a sticking position of the label to the object has to be accurately controlled. Accordingly, the present invention can provide a label sticking device furnished with adaptability to a case where, when the object is to be one plate-like body and the information printed on each label is serial and variable information like a serial number, the labels are stuck in line arrangement on the plate-like body without losing information continuity.

DETAILED DESCRIPTION OF THE PREFERRED EMBODIMENT

Preferred embodiments of the present invention will be described below with reference to the accompanying drawings.

Figure 1:
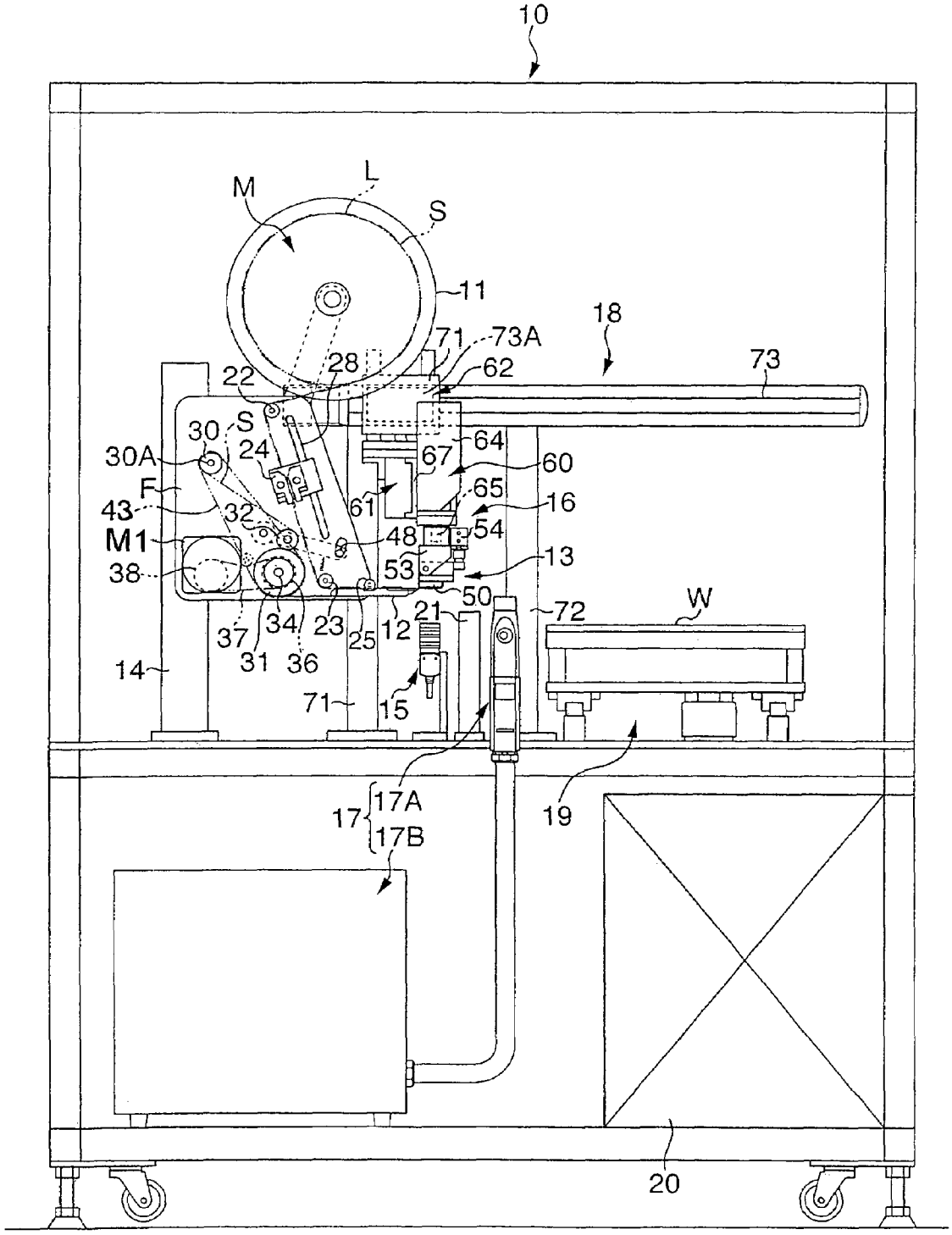
FIG. 1 is a schematic front view of a label sticking device in the embodiment.
Figure 2:
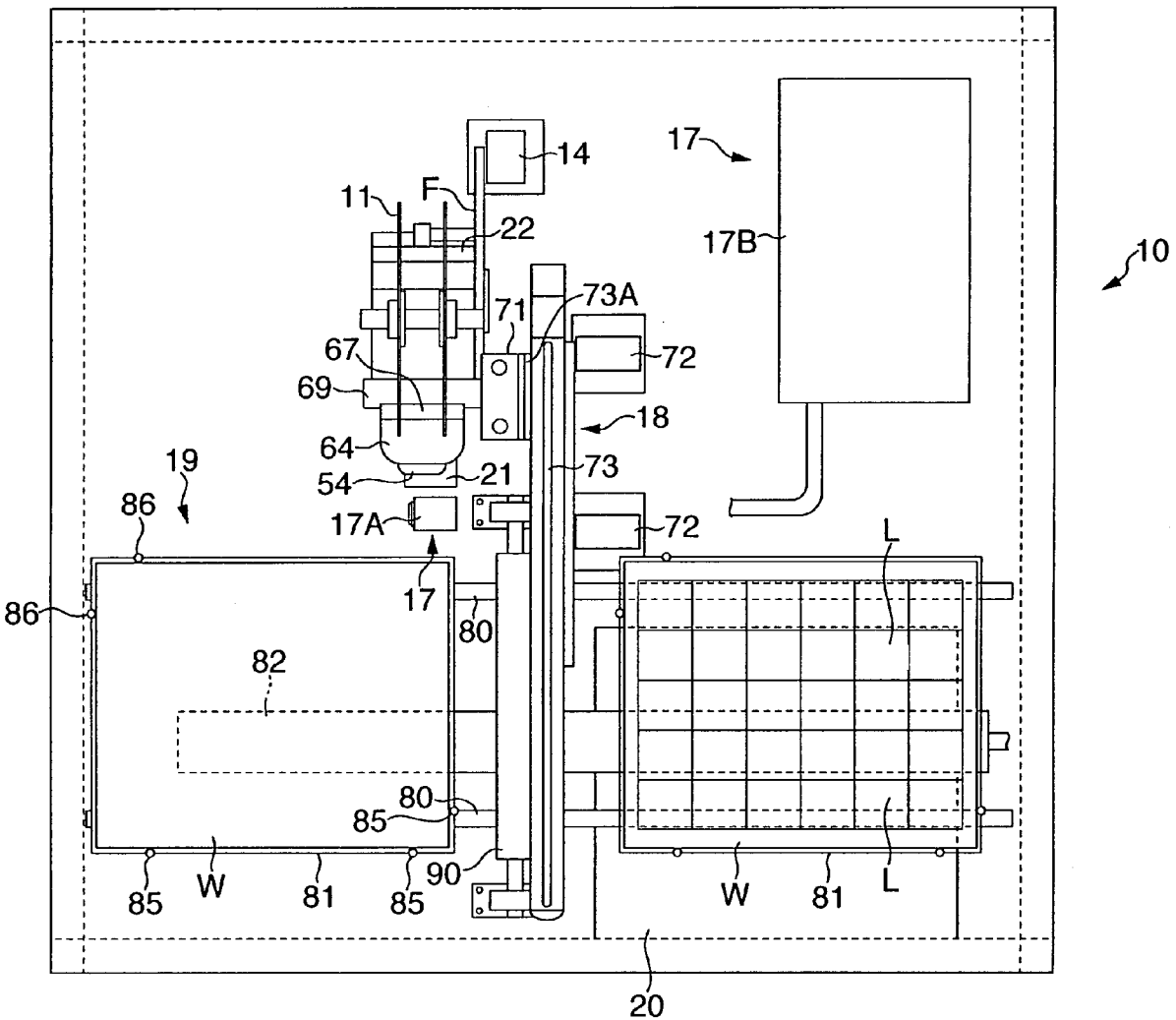
FIG. 2 is a schematic plan view omitting a part of the label sticking device.
Figure 3:
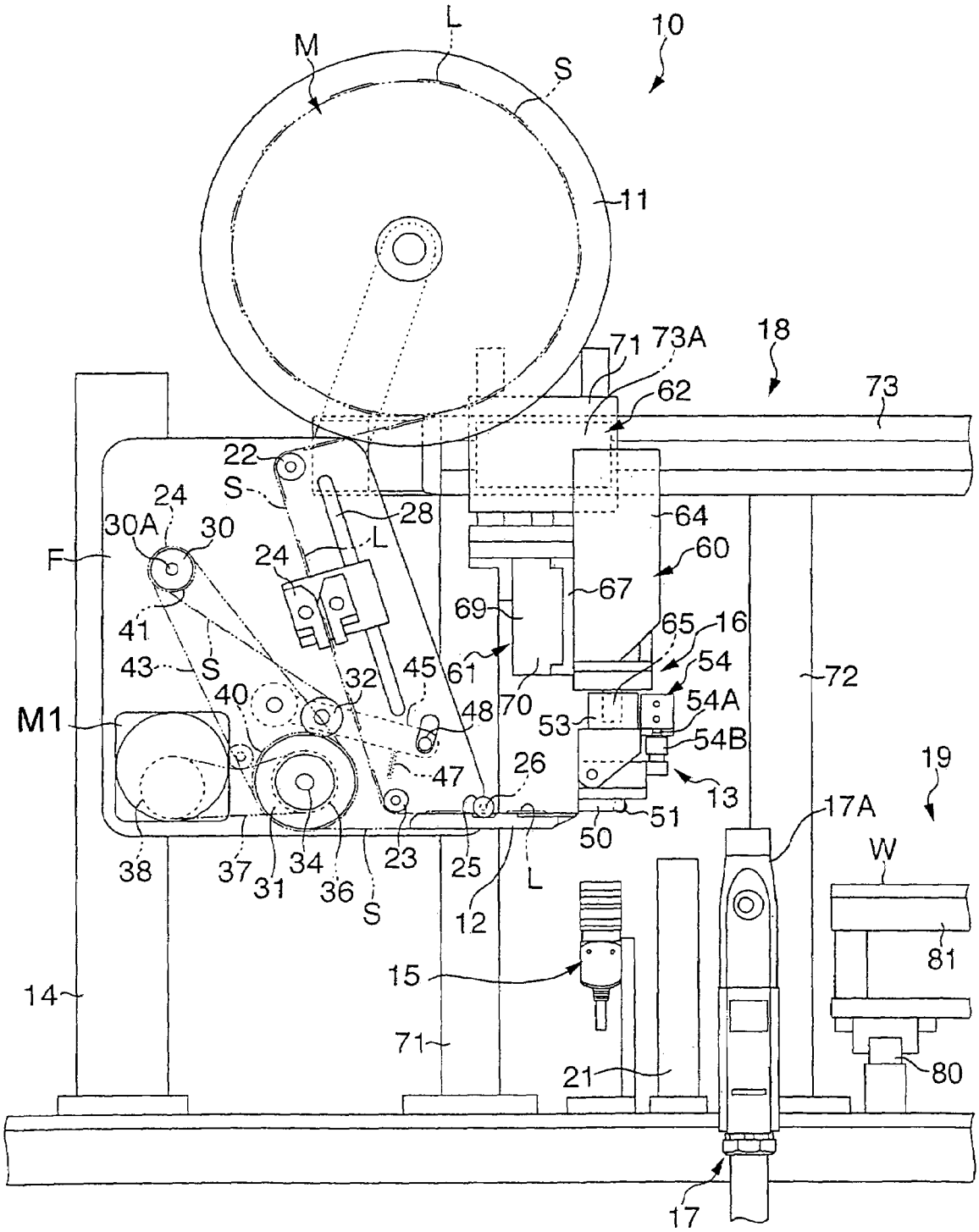
FIG. 3 is an enlarged front view of the main part of the label sticking device.

FIG. 1 shows a schematic front view in an embodiment of a label sticking device. FIG. 2 shows its schematic plan view. FIG. 3 shows an enlarged front view of the main part of FIG. 1. In these figures, a label sticking device 10, dealing with raw sheet M as an object, the raw sheet M being a strip-shaped release liner S on one of surfaces of which labels L having translucency are stuck temporarily, includes: a reel 11 supporting the raw sheet M above a plate frame F fixed on a post 14; a peel plate 12 disposed below the frame F to peel off a label L from the release liner S; a holding device 13 to suck and hold the peeled label L; a camera 15 as an inspection device to check out whether or not the label L held by the holding device 13 are located on a predetermined appropriate position; a label-positioning device 16 which adjusts the position of the label L at an appropriate position when a positional deviation of the label L held in the holding device 13 is detected; a printing device 17 such as an inkjet printer which prints on an adhesive layer of the label L; a shifter 18 which shifts the labels L after printing toward the plate body W as the object; a conveyance device 19 which supports and conveys the plate body W as the object along a predetermined direction; a controller 20 controlling these devices in a predetermined manner; and a collector 21 which collects defective labels, regarded defective ones when flaws and the like are detected on the label L by the camera 15.

Figure 4:
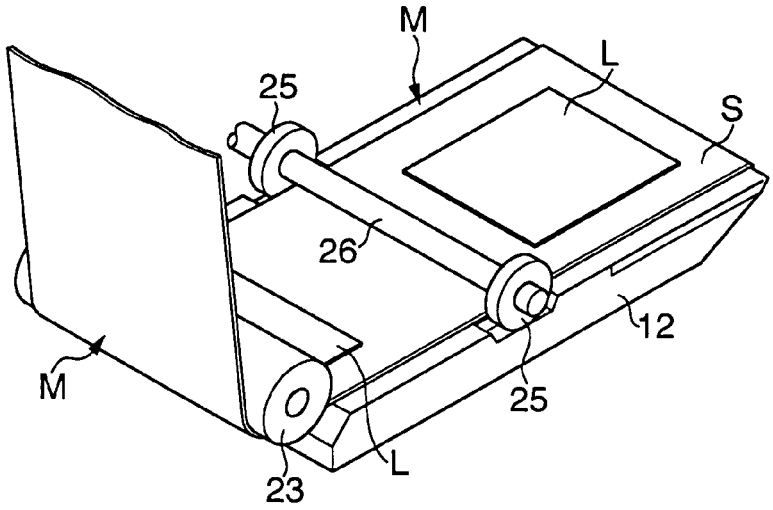
FIG. 4 is a schematic perspective view showing a peel plate area.

The raw sheet M is arranged to be paid out on the peel plate 12 through guide rolls 22 and 23, and a label edge detecting sensor 24 placed between the guide rolls 22 and 23, and turn sharply back downwards at a top end of the peel plate 12 (refer to the right end of FIG. 1), so that the labels L can be peeled off one by one from the release liner S. Herein, on the peel plate 12, as shown in FIG. 4, a pair of guide rings 25 which regulate a width direction shift of the raw sheet M are disposed, and also a guide roll 26 is provided linking these guide rings 25, which regulates floating up of the raw sheet M. Note that the label edge detecting sensor 24 is provided to be adjustable along a slot 28 formed within a plane of the frame F. This label edge detecting sensor 24 is formed, for example, of a light translucence type sensor, and is to detect a leading end or a rear end of the label L while the raw sheet M is intermittently paid out so that a stop position of the label L at a top end of the peel plate 12 is constant.

As shown in FIG. 3, the release liner S, after the labels L are peeled off by the peel plate 12, goes through a driving roll 31 and a pinch roll 32 in a plane of the frame F, and is laid around a winding roll 30 supported rotatably in the frame F. A rotating axis 34 of the driving roll 31 extends in the backward direction of the frame F and is provided with a pulley 36 at the rear end. A belt 37 is laid around the pulley 36. The belt 37 is positioned in the backside of the frame F and is provided to transmit a driving force to the driving roll 31 through being laid around a driving pulley 38 that is positioned in a backside of the frame F and connected to an output shaft of a motor M1. The rotating axis 34 of the driving roll 31 is provided with a driving pulley 40 disposed along with the pulley 36 and on the other hand, a rotating axis 30A of the winding roll 30 extends in the backside of the frame F and is provided with a driven pulley 41 and further, a slip belt 43 is laid between the driving pulley 40 and the driven pulley 41 to transmit a winding force to the winding roll 30. Note that the pinch roll 32 is supported by an arm 45 positioned in the backside of frame F and also is normally urged by a coil spring 47 in the direction to contact an outer periphery of the driving roll 31, whereby clearance formation is made between the pinch roll 32 and the driving roll 31 in the initial laying around work by shifting a knob 48 protruding upwards in the front side of the frame F from the arm 45 in the right end in FIG. 3.

Figure 6:
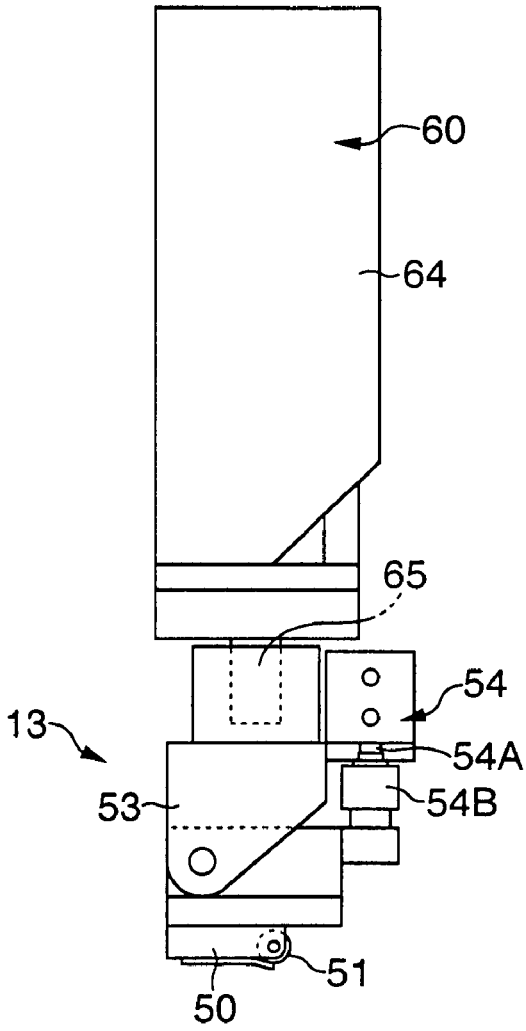
FIG. 6A is a front view showing an initial posture of a suction head.
FIG. 6B is a front view showing a posture of a suction head when sticking labels.
Figure 6:
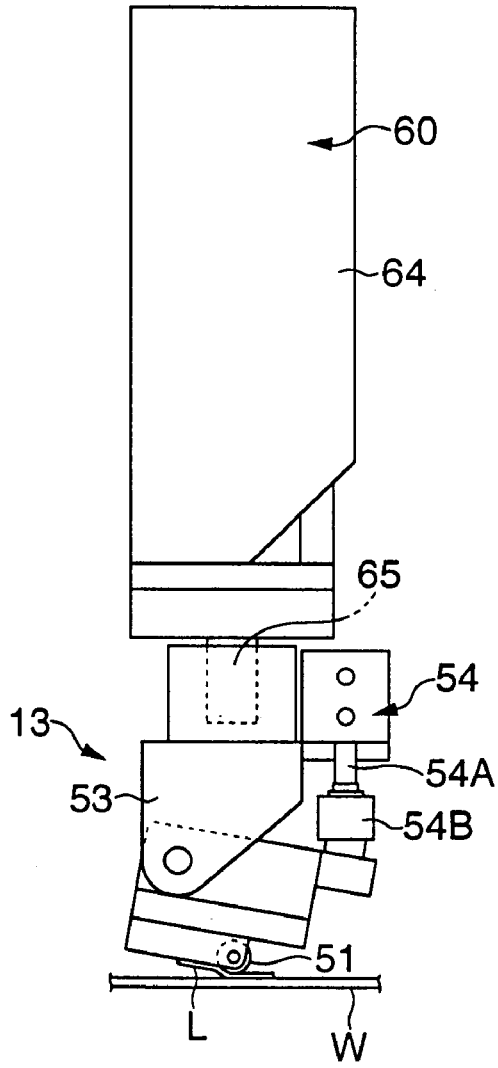

The holding device 13, as shown in FIG. 6A, is composed of a suction head 50 provided with suction holes in a lower surface. The suction head 50 is connected with a pressure-reducing device (not shown), and a pressing roll 51 is rotatably supported in the right end within the plane. The suction head 50 is rotatably supported at one end (the left end in FIG. 6A) of the upper portion thereof by a bracket 53, and on the other hand, a piston rod 54A of a cylinder 54 is connected to the right end of the suction head 50 through a universal joint 54B. Expansion of the piston rod 54A downwards can incline the suction head 50 so that one end of the suction head 50 is placed in a lower position at the side of the pressing roll 51 (refer to FIG. 6B).

The label-positioning device 16 is arranged to include a rotating driving part 60 which performs a function to adjust a tilt of the label L by rotating within a plane the label L sucked and held in the suction head 50, a width direction adjusting part 61 which performs a function to adjust both end-positions of the label L in the width direction perpendicular to the paying-out direction of the label L within the same plane therewith, and a front-rear direction adjusting part 62 which performs a function to adjust both end-positions of the front-rear direction along the paying-out direction. The rotating driving part 60 is arranged to include a servo motor 64 a rotating axis 65 of which is fixed in an upper portion of the bracket 53. Rotation of the rotating axis 65 allows the suction head 50 to be rotated via the bracket 53, whereby even if the label L is sucked obliquely within a plane with respect to the suction head 50, the label L can readily be adjusted. The width direction adjusting part 61 is arranged to include a slider 67 attached in the side of the servo motor 64 and an uni-axis robot 70 having a sliding base 69 extending in the direction perpendicular to a plane of FIG. 3. Motion of the servo motor 64 along the sliding base 69 can adjust the positional deviation of both ends of the label L in the width direction. The front-rear direction adjusting part 62 is arranged to include an air cylinder 71 which supports the uni-axis robot 70 to go up and down, a slider 73A to which an air cylinder 71 is attached, and a sliding base 73 fixed at upper portion of posts 72 and 72 so as to guide in the light-left direction in FIG. 3. When the label L deviates from a predetermined position on the suction head 50 in the front-rear direction, the suction head 50 is disposed so as to shift slightly in the right-left direction in FIG. 3 to adjust the front and rear end positions thereof.

The printing device 17 is provided with a printing head 17A at the side of the conveyance device 19 in the vicinity of the camera 15, and a device body 17B which actuates the printing head 17A for printing. Though an external input device such as a keyboard is not illustrated in the figures, the external input device is connected to the device body 17B.

The shifter 18 is formed substantially of the front-rear direction adjusting part 62 in the embodiment. That is, the suction head 50 is arranged to move along the slide base 73 by extending the slide base 73 to a position where the slide base 73 crosses over the conveyance device 19, whereby the suction head 50 can be moved between the an upper position of the plate body W and a sucking position of the label L.

Figure 5:
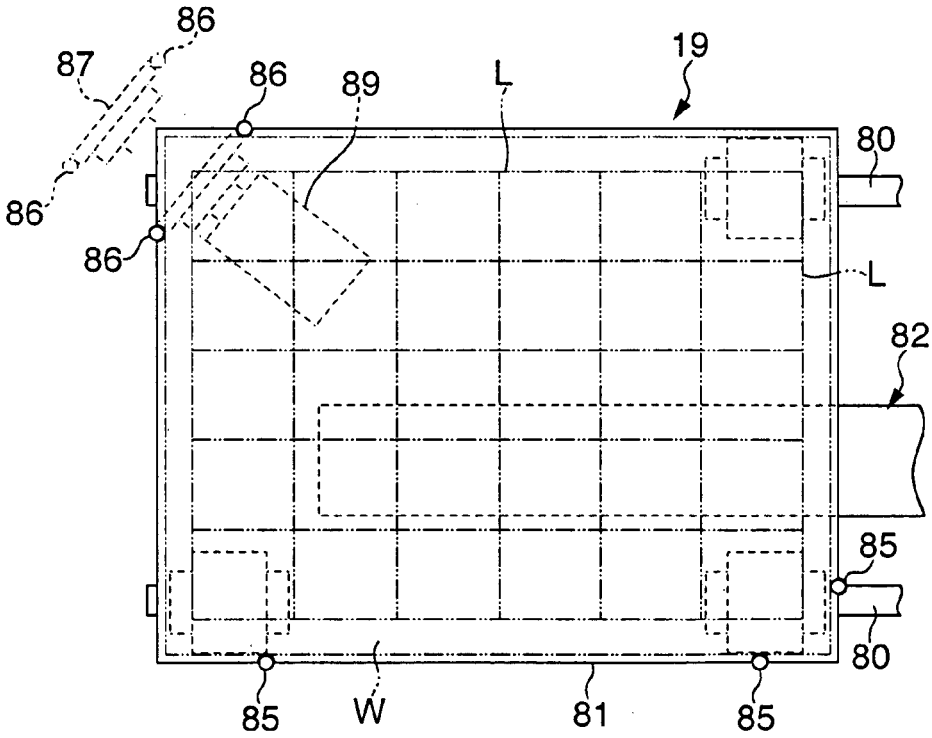
FIG. 5 is a schematic plan view of a conveyance device.

The conveyance device 19 is, as shown in FIG. 5, provided with two guide rails 80 and 80, a table 81 which can move along the guide rails 80 and 80, and a driving robot 82 to move the table 81. In the embodiment, the plate body W having a plane with a nearly equal size to that of the table 81 is disposed, and on a top face of the plate body W, lot of labels L can be stuck in longitudinal and lateral line arrangement. Pins 85 and 85 are disposed at a front end and one end of the both side ends of the table 81 in the conveyance direction in a manner to be projected upwards by a small margin from a top face of the table 81. Meanwhile movable pins 86 and 86 are disposed at a diagonal position from the pins 85 and 85. The movable pins 86 and 86 are connected with each other through a connecting member 87, and the connecting member 87 is connected with a cylinder 89 disposed in an lower face side of the table 81 and is arranged to move away (separated position) from the table 81 (refer to FIG. 5). Therefore, the movable pins 86 and 86 can be positioned at a distance from table 81 when the plate body W is set to the table 81, and thereafter, these movable pins 86 and 86 are moved to the position of a solid line in FIG. 5, thereby accurately positioning and fixing the plate body W on the table 81. Herein, a position-holding device of the plate body W includes the pin 85, movable pin 86, and the cylinder 89. In addition, as shown in FIG. 2, a press roll 90 is disposed on an upper portion of the table 81 in the downstream of the conveyance direction. The press roll 90 operates to press the label L stuck on a face of the plate body W when the table 81 goes through under the press roll 90.

The controller 20 is arranged to control the whole label sticking device 10 including such as: on-off control of a motor M1; a function of signals output to perform predetermined operations of the rotating driving part 60, the width direction adjusting part 61, and the front-rear direction adjusting part 62 based on the deviation amount of the label L determined through input of detection result by the camera 15; a function to control the printing device 17; a function to control the shifting device 18 corresponding to sequentially changing label-sticking positions; a function to move the conveyance device 19 by each predetermined amount; and the like.

And a collector 21 is, as shown in FIG. 3, provided between the camera 15 and the printing head 17A. The collector 21 is in an axis shape and the defective labels L can be stuck on a top end thereof and when a predetermined amount of the defective labels are accumulated, they are to be disposed of through manual operation.

Hereinafter, the whole operations of the embodiment will be explained.

A leading end of the raw sheet M supported by the reel 11 is pulled out and laid around a predetermined path to be fixed to a winding roll 30, and the label L positioned at a top end of the peel plate 12 is set in a position ready to be paid out so that one paying-out motion feeds the label L to a predetermined position of the suction head 50. In addition, the printing device 17 and the controller 20 are set in advance so that serial information such as a serial number or variable information is sequentially printed for each label L.

When the power is turned on, the driving roll 31 is rotated to impart paying-out force to the raw sheet M, the label L on the top end portion of the peel plate 12 is peeled off and sucked on the suction head 50, and the camera 15 inspects the label L sucked and held in the suction head 50. In case where no flaws are found on the label L by this inspection and it is detected that the label L is in a predetermined position relative to the suction head 50, the controller 20 provides a driving signal to the shifter 18 to shift the suction head 50 to a position over the printing head 17A. And the first serial number is printed on the adhesive layer of the label L to shift the suction head 50 to an upper position of the plate body W on which the label L is supposed to be stuck. On this occasion, the suction head 50 is shifted to an oblique posture so that the pressing roll 51 is placed in a low position by an operation of the cylinder 54. Then, the air cylinder 71 is lowered and the front end of the label L positioned right under the pressing roll 51 is contacted with the plate body W. And moving the suction head 50 in the direction of the initial waiting position for label suction allows the first label L to be stuck on the plate body W, and the suction head 50 elevates after completion of the sticking and goes back to the waiting position for suction.

Herein, in case where a defect of the label L is detected by the camera 15 when the suction head 50 sucks the second label L, the defective label L is stuck on the collector 21 for collection. And in case where inclination and the positional deviations of the width and front-rear directions of the label L within a plane thereof are detected, the controller 20 determines the deviation amount based upon a signal input from the camera 15, and then the rotating driving part 60, the width direction adjusting part 61, and the front-rear direction adjusting part 62 are respectively operated based upon the deviation amount to adjust the label L to be placed in an appropriate position. And the printing is made on a condition that it is detected by the camera 15 that the adjustment is appropriately made, and the suction head 50 is shifted to a position where the second label L is supposed to be stuck for sticking.

Note that, when the label L sucked in the suction head 50 reaches a predetermined position on the printing head 17A, a sensor (not shown) detects the fact and the printing head 17 prints the information sequentially.

When the labels L are thus stuck on the plate body W at all positions of the first line in the width direction thereof, the conveyance device 19 starts to drive so that the second line goes ahead to a position where the first line was positioned. After the label sticking is completed in all lines, as shown in FIG. 2, the plate body W is advanced in the right side and the plate body W with the labels L stuck thereon is transported to a stocker or to the following process by an operator.

Consequently, according to the embodiment, it is possible to provide a label sticking device and a label sticking method which can achieve such an excellent operation and effect that the label L peeled off from the release liner S can be placed in an appropriate position and thus stuck keeping accurately a sticking position of the label L.

As described so far, the best arrangement and method to carry out the present invention are disclosed in the above description, but the present invention is not limited to this.

Namely, the present invention illustrates and describes particularly a specific embodiment, but it is apparent that those skilled in the art can implement various modifications in shapes, positions or arrangements with regard to the described embodiment within the scope of the technical concept and object of the present invention.

For example, after the printing is completed, the printing state can be further inspected. When printing defects are found, the defective label L is collected, and meanwhile, it is possible to print the previous printing information of the defective one on the label L transferred to the printing position. Note that the printing information may not be necessarily variable information.

The width direction adjusting part 61 of the label L according to the above-described arrangement can be omitted. In that case, the adjusting part 61 can be replaced by shifting the conveyance device 19 temporarily in the front-rear direction along the conveyance direction. In such width direction position adjustment, the printing position on the label L deviates slightly in the width direction, but if the label L is not inclined, since no extreme deviation in the width direction is generated, the deviation may be allowed.

What is claimed is:

1. A label sticking device, comprising:

a holding device which holds a label peeled off from a strip-shaped release liner in the process of paying out a raw sheet, the raw sheet including the label temporarily stuck on a face of the strip-shaped release liner;

an inspection device which inspects a position of the label held by said holding device;

a label-positioning device which adjusts the position of the label to a predetermined position when the position of the label detected by said inspection device deviates from the predetermined position of said holding device;

a printing device which prints on an adhesive layer of the label;

a shifting device which shifts a printed label toward an object; and a controller which performs predetermined controls for each of said holding device, said inspection device, said label-positioning device, said printing device and said shifting device, wherein said label-positioning device adjusts the inclination of the label by rotating the label within a plane, and wherein said inspection device detects the inclination of the label, relative to the plane within which the label is rotated.

2. The label sticking device according to claim 1, wherein said label-positioning device adjusts the position of the label in a direction perpendicular to the direction of paying out of the label; and wherein said label-positioning device adjusts the position of the label in a direction parallel to the direction of paying out of the label.

3. The label sticking device according to claim 1, further comprising a peel plate for peeling the label from the release liner, wherein said holding device holds the label at an initial waiting position, said initial waiting position being disposed at a side of said peel plate which is forward of a point where the label is peeled from the release liner, in a paying-out direction, and wherein said inspection device inspects the position of the label held on said holding device at the initial waiting position.

4. The label sticking device according to claim 1, 2, or 3, wherein said inspection device is provided with a collector of defective labels, and wherein when said inspection device detects a defect of the label held by said holding device, the defective label is collected without printing on the label.

5. The label sticking device according to claim 4, wherein said printing device prints serial or variable information corresponding to an order of the label to be stuck, and wherein printing information is printed based upon said serial information at each time of printing when the label held by said holding device reaches a predetermined printing position.

6. The label sticking device according to claim 5, wherein said object is a plate-like body which is larger than a label plane size, and wherein a plurality of the labels are sequentially stuck in a line arrangement on a face of the plate-like body.

7. The label sticking device according to claim 6, wherein said object is supported by a predetermined conveyance device, wherein said predetermined conveyance device includes a position-holding device to keep the object in a predetermined position.

8. The label sticking device according to claim 1, wherein the plane within which the label is rotated is parallel to a plane of the peel plate.

9. The label sticking device according to claim 1, wherein the plane within which the label is rotated is oblique to a plane of the peel plate.

10. A label sticking method, comprising the steps of:

inspecting whether or not a label is held at a predetermined position when holding the label peeled off from a strip-shaped release liner after a raw sheet including the labels temporarily stuck on a face of the release liner is paid out;

adjusting a position of the label to the predetermined position when the label is determined not to be held at the predetermined position in the inspecting step, said adjusting including adjusting the inclination of the label by rotating the label within a plane;

printing on an adhesive layer of the label if the label is at the predetermined position; and sticking the label so that a printed face is interposed between the label and an object, wherein said inspecting step detects the inclination of the label, relative to the plane within which the label is rotated.

11. The label sticking method according to claim 10, wherein said printing includes serial information or variable information corresponding to an order of the label to be stuck.

12. The label sticking method according to claim 10, wherein said adjusting further includes adjusting the position of the label in a direction perpendicular to the direction of paying out of the label; and wherein said adjusting further includes adjusting the position of the label in a direction parallel to the direction of paying out of the label.

13. The label sticking method according to claim 10, wherein the plane within which the label is rotated is parallel to a plane of the peel plate.

14. The label sticking method according to claim 10, wherein the plane within which the label is rotated is oblique to a plane of the peel plate.

* * * * *